US010113401B2

(12) United States Patent
Al-Gouhi

(10) Patent No.: US 10,113,401 B2
(45) Date of Patent: Oct. 30, 2018

(54) APPARATUS AND METHOD EMPLOYING PERFORATING GUN FOR SAME LOCATION MULTIPLE RESERVOIR PENETRATIONS

(71) Applicant: Saudi Arabian Oil Company, Dhahran (SA)

(72) Inventor: Alwaleed Abdullah Al-Gouhi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 14/959,942

(22) Filed: Dec. 4, 2015

(65) Prior Publication Data

US 2016/0108708 A1 Apr. 21, 2016

Related U.S. Application Data

(62) Division of application No. 13/945,412, filed on Jul. 18, 2013, now Pat. No. 9,506,330.

(60) Provisional application No. 61/673,482, filed on Jul. 19, 2012.

(51) Int. Cl.

| | |
|---|---|
| ***E21B 43/119*** | (2006.01) |
| ***E21B 43/117*** | (2006.01) |
| ***E21B 43/263*** | (2006.01) |
| ***E21B 47/09*** | (2012.01) |

(52) U.S. Cl.

CPC ..... *E21B 43/119* (2013.01); *E21B 43/117* (2013.01); *E21B 43/263* (2013.01); *E21B 47/09* (2013.01)

(58) Field of Classification Search

CPC ..... E21B 43/119; E21B 43/263; E21B 47/09

See application file for complete search history.

(56) References Cited

U.S. PATENT DOCUMENTS

| | | | | |
|---|---|---|---|---|
| 2,653,007 A * | 9/1953 | Aston | E21B 7/061 | 166/114 |
| 2,679,898 A | 6/1954 | Forsyth et al. | | |
| 3,307,642 A * | 3/1967 | Smith | E21B 43/119 | 166/55.1 |
| 3,414,071 A * | 12/1968 | Alberts | E21B 41/00 | 166/100 |
| 3,653,435 A * | 4/1972 | Reistle, III | E21B 43/14 | 166/313 |

(Continued)

FOREIGN PATENT DOCUMENTS

EP 0256178 A1 2/1988

OTHER PUBLICATIONS

International Search Report & Written Opinion in corresponding International Application PCT/US2013/051239, dated May 19, 2014, 7 pages.

*Primary Examiner* — Cathleen R Hutchins
*Assistant Examiner* — Ronald R Runyan
(74) *Attorney, Agent, or Firm* — Abelman, Frayne & Schwab

(57) ABSTRACT

Methods and apparatus are provided for conducting multiple successive same-location firings of a number of shaped charges carried by a perforating gun that is lowered into the wellbore and precisely positioned to align its charges with the penetration created by the first fired-charges in order to produce deeper and larger diameter penetrations that result in enhanced hydraulic fracturing of the reservoir and increased gas production from the completed well.

7 Claims, 14 Drawing Sheets

(56) References Cited

U.S. PATENT DOCUMENTS

| | | | | |
|---|---|---|---|---|
| 4,619,333 | A * | 10/1986 | George | E21B 43/116 166/297 |
| 5,353,873 | A | 10/1994 | Cooke, Jr. | |
| 5,865,252 | A | 2/1999 | Van Petegem et al. | |
| 5,890,539 | A | 4/1999 | Huber et al. | |
| 6,298,915 | B1 | 10/2001 | George | |
| 6,394,184 | B2 | 5/2002 | Tolman et al. | |
| 6,776,239 | B2 | 8/2004 | Eslinger et al. | |
| 7,172,023 | B2 | 2/2007 | Barket et al. | |
| 7,303,017 | B2 | 10/2007 | Barker et al. | |
| 7,913,603 | B2 | 3/2011 | LaGrange et al. | |
| 7,980,309 | B2 * | 7/2011 | Crawford | E21B 43/1185 166/250.15 |
| 8,079,296 | B2 | 12/2011 | Barton et al. | |
| 2004/0216632 | A1 * | 11/2004 | Finsterwald | F42D 1/043 102/310 |
| 2005/0194181 | A1 * | 9/2005 | Barker | E21B 43/119 175/4.55 |
| 2006/0243443 | A1 | 11/2006 | Matthews | |

* cited by examiner

APPARATUS AND METHOD EMPLOYING PERFORATING GUN FOR SAME LOCATION MULTIPLE RESERVOIR PENETRATIONS

RELATED APPLICATIONS

This application is a division of, and claims priority from parent application U.S. Ser. No. 13/945,412, filed 18 Jul. 2013, entitled "SYSTEM AND METHOD EMPLOYING PERFORATING GUN FOR SAME LOCATION MULTIPLE RESERVOIR PENETRATIONS," which claims priority to provisional patent application U.S. Ser. No. 61/673,482 filed Jul. 19, 2012, the contents of which are incorporated herein by reference.

FIELD OF THE INVENTION

This invention relates to the use of perforating guns, including tubing-conveyed perforating (TCP) guns for perforating tight reservoir formations, e.g., in preparation for hydraulic fracturing of the formation.

BACKGROUND OF THE INVENTION

Tight gas formations, such as Khuff carbonate, pre-Khuff sandstone and shale gas formations with high compressive strength require hydraulic fracturing procedures in order to open the reservoir formation and enhance the flow of gas to the well bore for production. In such tight gas-containing reservoir formations, a perforating gun is used to initiate formation breakdown by detonating high-performance deep-penetrating shaped charges that maximize perforation length and entry hole size to start the hydraulic fracturing or "hydrofracking", in order to enhance hydrocarbon production and optimize well flow.

The tubing-conveyed perforating (TCP) gun employs a drilling rig at the surface in operation to handle the tubing that conveys the gun to the desired depth in the well bore.

Perforating guns are available in various configurations. In each case, the key objective of the selection of the gun and the size, nature and set up of the shaped charges is to create a predetermined pattern of perforations over a predetermined wellbore interval.

Currently, stimulation of the reservoir is commenced after a single gun run to perforate the reservoir. The creation of deep perforations with large diameters has been a problem that has not been solved by the petroleum industry and there is a compromise between perforation diameter and penetration depth. To create deep perforations that bypass damaged zones, the perforation diameter should be small and the force of the shaped charge narrowly focused. Current perforation practices fail to provide deep penetration with large diameter penetration, especially in formations with high compressive strength, and also can fail to bypass formation damage.

The problem to be solved is how to provide a new method for initiating the hydraulic fracturing in tight gas reservoirs at a deeper point of penetration having a larger diameter than is currently possible in order to thereby improve well productivity and injectivity. Currently, the hydraulic fracturing of tight formations is initiated after only a single reservoir perforation. It would be desirable to provide a method and apparatus capable of completing a plurality of reservoir perforations or penetrations at the same position in order to produce a deeper penetration with a larger diameter before the hydraulic fracturing is commenced.

The problem can also be stated as how to position and maintain the TCP gun at the same location for successive or repeated reservoir penetration shots in wells operating with a rig, or perforating guns that are deployed by wireline and/or coiled tubing unit.

An associated problem is to provide a latching tool having the capability of unlatching with a downward force in addition to the current upward unlatching force.

SUMMARY OF THE INVENTION

The above problems are solved and other objectives are met by an embodiment of the method and apparatus of the present invention in which a latching tool and tubing-conveyed perforating (TCP) gun are lowered into the wellbore by the rig and engage a latch coupling secured to a section of a well casing proximate the predetermined interval in the wellbore that is to be perforated. Withdrawal after the first firing and recharging of the gun, followed by its return and engagement of the latching tool with latch coupling to perforate tight formations repeatedly and at the same position results in extending the depth of the initial lateral perforations further into the surrounding formation. The greater depth and the larger diameter of penetration will facilitate the start and improve the effectiveness of the hydraulic fracturing to enhance hydrocarbon recovery by extending the penetration past any damaged areas in the wall of the wellbore. As will be explained below, the latch coupling and latching tool method and apparatus provides a consistent, reproducible reference at the predetermined depth and orientation for repeated use of the TCP gun in vertical and lateral wells.

A latch coupling that is suitable for use in the invention is sold by Halliburton under the brand name "SperryRite". It is designed for use in an advanced reservoir drainage multilateral system. It allows full-bore unrestricted access to the main bore and provides a consistent, repeatable reference for the depth and orientation of multilateral tools. The construction of this Halliburton SperryRite tool and its mode of operation will be described to facilitate an understanding of its use in the present invention. The latching tool is constructed with four (4) spring-loaded keys that are located on the lower section of the tool. These keys are driven in the ID of the casing wall with great force. When the tool is run into the well casing, 8000 to 12000 pounds of force is required to push the tool into the well. The keys will only expand when the correct key segment is in the correct recess in the latch coupling. Unless the keys are fully expanded into the correct recesses, the tool will not hold much more weight than that which is required to push the tool into the well. In addition, the square shoulders of the latch keys will not allow rotation once they have "found" and expanded into the correct recesses in the latch coupling. The tool is set to release at about 40,000 pounds of straight pulling force, according to the manufacturer's specifications.

In an embodiment suitable for the practice of the invention, the novel apparatus is assembled in accordance with the following procedure:

1. The latch coupling is secured to the casing and forms an integral part of the last section of well casing and is placed so that it will be positioned above and in close proximity to the tight gas reservoir interval that has been targeted for hydrofracking.
2. The latching tool is secured to the end of a section of tubing and the TCP gun is secured to the downhole end of the latching tool and is run in, or lowered into the hole by the tubing.
3. As the TCP gun and the latching tool are run into the casing and reach the latch coupling depth, the latching tool engages the latch coupling and sets the TCP gun in a fixed position a predetermined interval.

4. The shaped charges previously loaded into the TCP gun are fired and the reservoir rock is perforated for a first time at a plurality of lateral positions.
5. With appropriate over pull force, the latching tool is released from the latch coupling and pulled out of the hole with the TCP gun for re-loading with new charges for the second run.
6. By running the TCP gun more than one time with the same TCP gun charge orientation and spacing, the engagement of the latching tool with the fixed latch coupling will provide a repeatable accurate reference for the depth and orientation of the TCP gun. As a result, the reservoir can be perforated more than once at precisely the same positions, thereby providing deeper openings at each penetration point.
7. The latching tool and gun are again disengaged and withdrawn from the wellbore, and the gun is removed from the latching tool.
8. The hydraulic fracturing completion tool is attached to the latching tool and is lowered into position in the wellbore where it engages the latch coupling. The hydrofracking tool is configured and secured to the latching tool so that its fracturing ports are spaced and aligned to match the spacing of the TCP gun charges and the corresponding reservoir perforations. The fracturing ports of the completion are thereby aligned with the perforations in the formation to start the hydraulic fracturing from deeper penetration positions than was possible using the methods of the prior art which begin after only a single reservoir perforation shot by the TCP gun.

Another embodiment of the invention which avoids the necessity of running the perforating gun repeatedly into and out of the well, stacked latching tools are secured to tubing at predetermined positions on the tubing above the gun and the gun is constructed with multiple drop firing sections. For example, if the same interval in the reservoir is to be penetrated three times, the top of the gun will be assembled with three latching tools and the shaped charge portion of the gun will include three firing sections. The lower-most latching tool after engagement in the latch coupling will position the lower-most firing section of the gun opposite the target interval in the reservoir that is to be perforated for the first time. After firing the first charge in this section, the section will drop to the bottom of the well which known as the "rat hole". The rat hole is an additional footage drilled in the well to dispose of redundant tools and avoid the cost of retrieving them. The gun is then lowered for the second latching tool to engage with the latch coupling and to position the next charge section in the same position as the first gun section. The second gun section will penetrate deeper in the same openings created by the first gun section and after firing it will also drop to the bottom of the well. The sequence is repeated for the third section of shaped charges that are fired in the same location to extend the depth of the penetration and enlarge the hole. The second and third set of shaped charges that are fitted into the gun are designed and configured to effect the second and subsequent shot into the penetration created by the first shot, the second shot effecting a deeper penetration into the formation and enlarging its diameter. The selection and placement of the shaped charges in the gun are well within the skill of the art.

The latching tool, latch coupling and the gun is modified for this embodiment. The modified latching tool has the capability of unlatching with a downward force in addition to the current and conventional mode of operation in which unlatching is effected by a predetermined upward force.

The gun can also be modified to provide the capability of firing in multiple vertical locations. This enables the gun to be lowered to a different interval in the wellbore that is displaced below the first interval. As modified in accordance with the present invention, the gun also has the capability of completing multiple series of discreet firings at the same and different intervals in the reservoir.

In another embodiment, the perforating gun is configured to receive a plurality of first shaped charges and a plurality of second shaped charges and functions in a manner similar to that described above, with the exception that after firing the first and second shaped charges into the perforations in a first interval, the gun is moved to a second interval where the first and second firing procedure is repeated. As will be understood by one of ordinary skill in the art, the ability to create deep penetrations by positioning the gun for a first and second firing at the same spot without retrieving the gun to the surface for reloading will result in a significant cost savings in bringing the well into production.

In another embodiment of the invention, the downhole end of the final section of production tubing is equipped with a profile nipple that is placed in final position above and approximate to the reservoir interval that is to be penetrated. The profile nipple provides a fixed reference point for the depth of the perforating gun, as will be explained in further detail below.

The perforating gun is removably secured to a gun landing and orienting tool, which for convenience is referred to hereinafter as the GLOT. The GLOT will be run in the well using a wireline or coil tubing unit. In an embodiment, the gun will be retrieved after each firing for reloading.

The assembly comprising the GLOT and removable perforating gun will be landed on the profile nipple for depth control. Two or more extendible arms are activated to securely retain the GLOT against the inside of the profile nipple after it has come to rest. The GLOT also includes a directional survey tool with receiver sensors, a tool direction transmitter (TDT) that serves as a direction locator, a motor positioned in the GLOT housing and operable in response to signals generated by a microprocessor/controller and associated memory. The gun is removably secured to a shaft which is operably connected to the motor for rotation. The shaft is also equipped with a shaft direction transmitter (SDT) which serves as the shaft direction locator.

In accordance with the method of operation of the invention, upon the first landing of the GLOT and gun assembly in the profile nipple, the TDT, the SDT and the gun charges are all aligned in the same direction. Upon firing the gun, the first penetration(s) in the formation interval will be made in the direction of the TDT and the SDT. Following the first firing, the GLOT is released from the profile nipple, returned to the surface for reloading of the gun with new charges, and returned to its landed position on the nipple for the second formation penetration.

The arms of the GLOT are extended into secure contact with the interior of the profile nipple in order to firmly anchor it in a fixed position. The direction survey tool determines the new landed position of the TDT and the SDT. Signals are transmitted to the processor which in turn transmits a signal to the motor and the shaft to which the gun is securely attached is rotated by the motor to position the SDT at the original landed position. The gun's shaped charge is now opposite the first penetration in the formation and upon firing, will pass through and extend the perforation in the same location.

A third or subsequent charge(s) can also be fired following this procedure which provides for accurate same-location penetrations, even though the gun is withdrawn from its downhole position for reloading and then repositioned downhole.

As will be understood from the above description, the ability to perform repeated perforations at the same location provided by the embodiments of this invention will overcome the obstacles imposed by the conventional method which is a single reservoir perforation before starting the hydraulic fracturing process. Use of the invention provides deeper perforations that bypass the near-wellbore damaged zone. It is the practice in the prior art in order to penetrate the formation deeper to bypass the near-wellbore damaged zone to use a smaller charge which results in a smaller diameter opening. This is not a favorable configuration in which to initiate hydraulic fracturing in a tight formation. The present invention provides the large and deeper holes needed to reach the virgin part of the reservoir for higher well or well injectivity and/or productivity.

BRIEF DESCRIPTION OF THE DRAWINGS

The invention will be described in more detail below and with reference to the attached figures in which the same or similar elements have the same number, and where.

DETAILED DESCRIPTION OF INVENTION

Figure 1C:
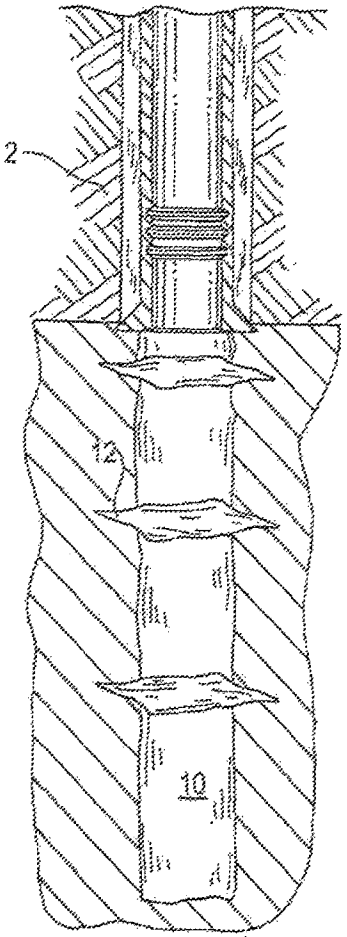
FIGS. 1A through 1F schematically illustrate the stepwise use of the method and apparatus of the invention to prepare a wellbore in a tight reservoir formation for the placement of a hydraulic fracturing completion tool for use.
Figure 1B:
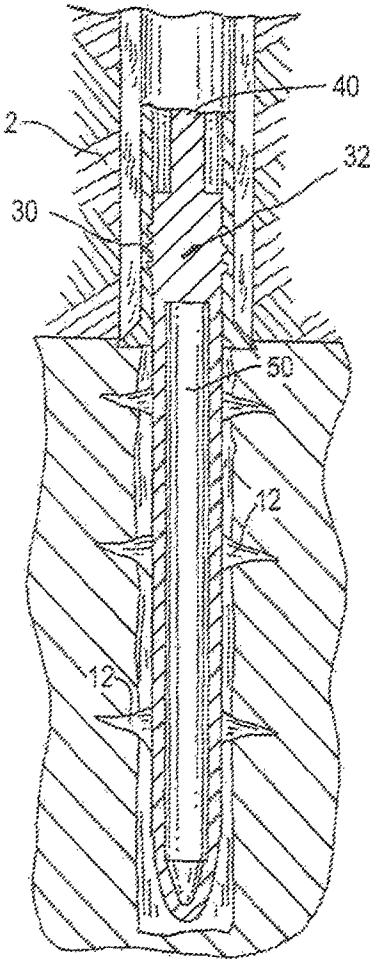
Figure 1A:
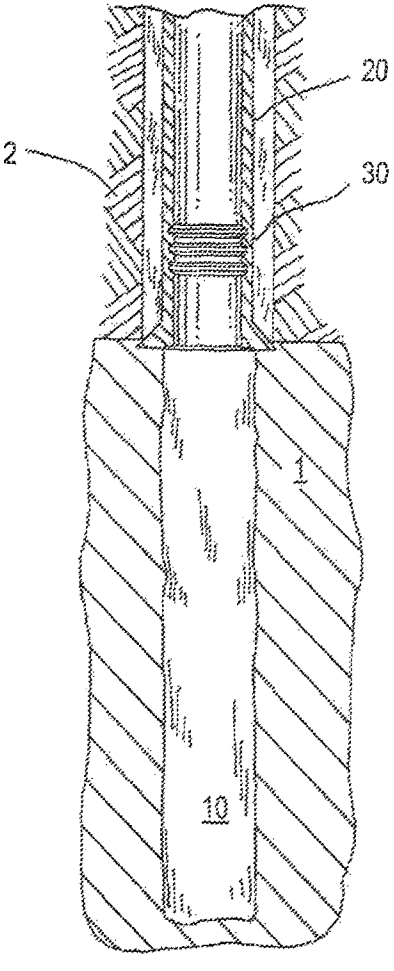

Referring to the series of illustrations identified as FIGS. 1A to 1F, there is schematically illustrated an open or uncased section of wellbore 10 in a section of reservoir rock 1 in a tight formation in which hydraulic fracturing is required to enhance gas production. It is to be understood that the region 2 above the section of reservoir rock 1 in a tight formation can extend for thousands of feet from the earth's surface prior to reaching the reservoir rock in a tight formation in which hydrofracking is required. As shown in FIG. 1A, the final section of well casing 20 includes a latch coupling 30 of the prior art.

With reference to FIG. 1B, the downhole end of a length of tubing 40 is shown secured to a latching tool 32 that is held securely in place by its engagement with latch coupling 30. Removably attached to the downhole end of the latching tool 32 is TCP gun 50 with its shaped charges positioned adjacent the predetermined interval of the tight formation which is to be perforated. As is known in the prior art, the charges can be positioned on all sides of the TCP gun and spaced at various angles best suited for the particular formation type and local conditions. Following the firing of the charges positioned in the TCP gun, a first plurality of formation perforations 12 are created that extend radially from the axis of the TCP gun and wellbore.

After firing of gun 50, a sufficient pulling force is exerted on the tubing to disengage the projecting elements of latching tool 32 from the corresponding openings in the latch coupling 30. FIG. 1C represents the location with the plurality of lateral perforations 12 extending from the open hole 10 with the gun 50 returned to the surface for replacement of the shaped charges.

Figure 1F:
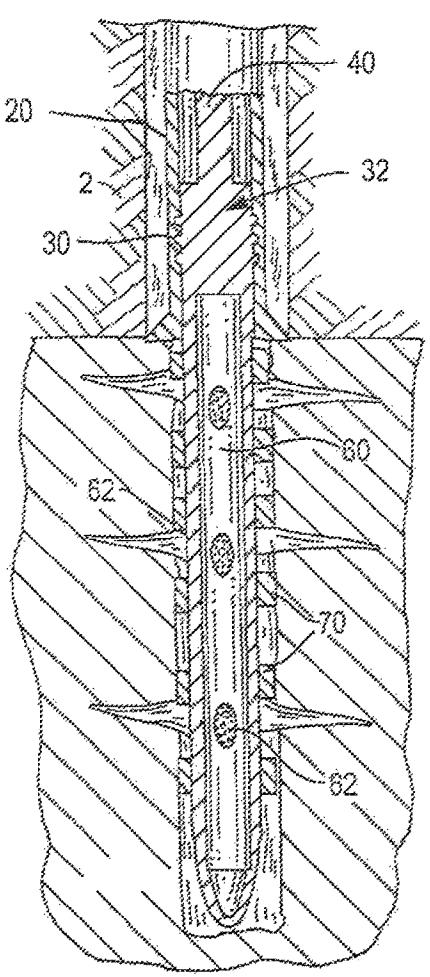
Figure 1E:
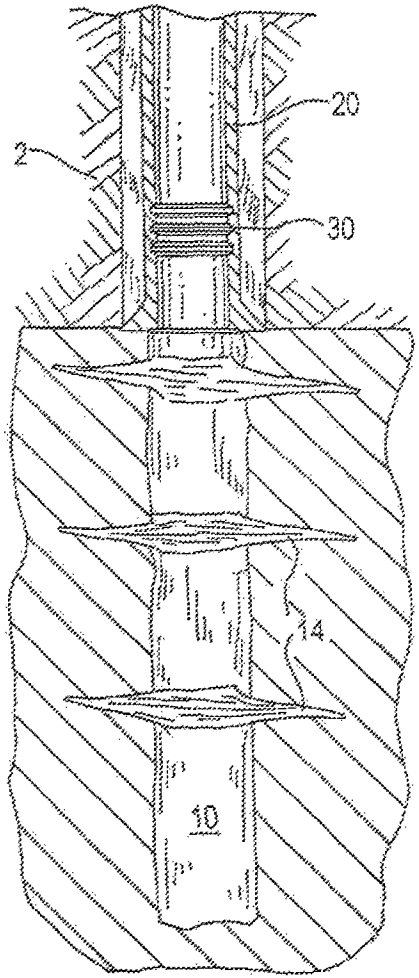
Figure 1D:
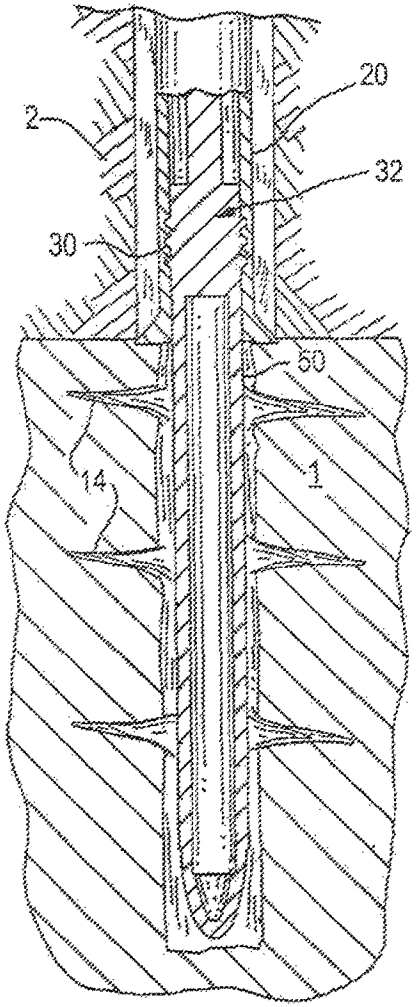

Referring to FIG. 1D, the gun has been returned to the same position as in FIG. 1B by engagement of the latching tool with the latch coupling. A second firing of the perforating charges in the gun 50 produces a deeper penetration of the formation rock 1 to a lateral position 14. As will be understood from the illustration, the latch coupling 30 remains secured in position at the downhole end of casing 20 and the latching tool 32 engages the latch coupling 30 to position and orient TCP gun 50 in precisely the same location for the second firing of the penetrating charges. The result is a second and deeper penetration into the reservoir rock formation surrounding the bore.

The effect of the second firing is shown in FIG. 1E with the plurality of laterally-extending perforations 14 and the tubing 40 with attached latching tool 32 and gun 50 withdrawn to the surface in preparation for the next step.

With reference to FIG. 1F, the hydraulic fracturing completion tool 60 has been secured to the latching tool 32 following removal of the gun 50 and lowered by means of tubing 40 in position for engagement with the latch coupling 30. As shown in the schematic illustration, the ports 62 of the hydrofracking completion tool 60 are aligned with the plurality of secondary penetrations 14. Also shown in FIG. 1F are a plurality of packers 70 which serve to isolate the hydraulic fracturing fluid as it is discharged from ports 62 to assure maximum penetration of the fluid into the surrounding formation 1 and avoid its premature loss down the wellbore 10.

From the above description and illustrations, it will be understood that after the second firing, the gun can be reloaded and returned with the latching tool for engagement with the latch coupling and a third firing to effect even deeper penetration at the same location in the interval. The selection of shaped charges for the second and any subsequent firings of the TCP gun in order to produce the depth and diameter of the penetrations 14 in specific types of reservoir rock are within the skill of the art.

The method and apparatus of the present invention overcomes tight formation productivity problems because the same interval can be perforated two or more times to create the large and deeper holes needed to reach the virgin part of the reservoir for higher well productivity or well injectivity. Additionally, this technique will facilitate stimulation treatment especially in tight formations which are of high compressive strength where achieving deep perforation penetration is particularly difficult. This invention provides for the efficient perforation of tight rock formations to achieve successful hydraulic fracturing treatments.

Figure 2:
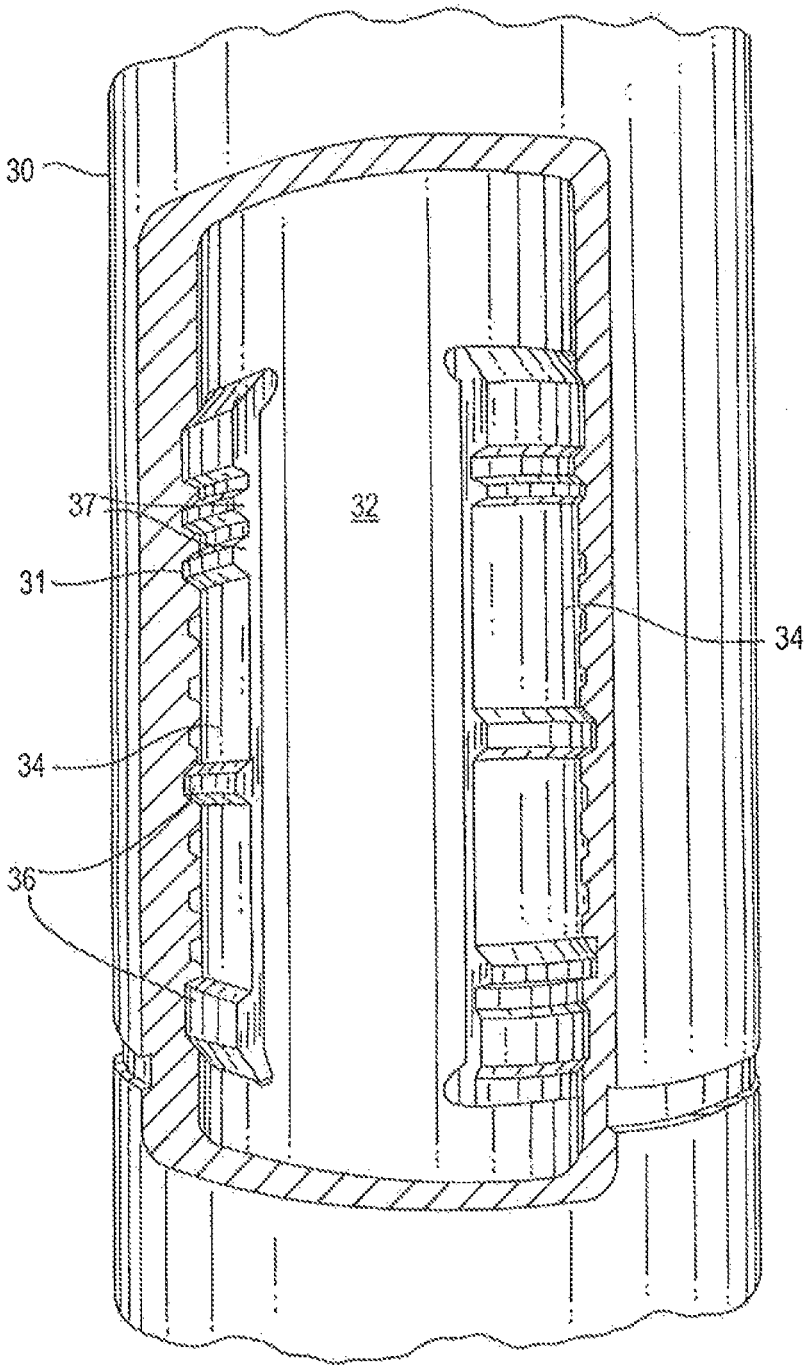
FIG. 2 PRIOR ART
FIG. 2 is an illustration, partly in section, showing a latching tool in an engaged position with a latch coupling.

The partial sectional view of FIG. 2 shows a typical latch coupling 30 and latching tool 32 of the prior art. The spring-loaded projecting members 34 of the latching tool include projecting members 36 that engage openings 31 in the latch coupling to assure consistent, repeatable alignment of these elements. The projecting members 36 have flat surfaces 37 that prevent the latch coupling from rotating once engaged in the mating openings 41 in the latch coupling 30.

Figure 3:
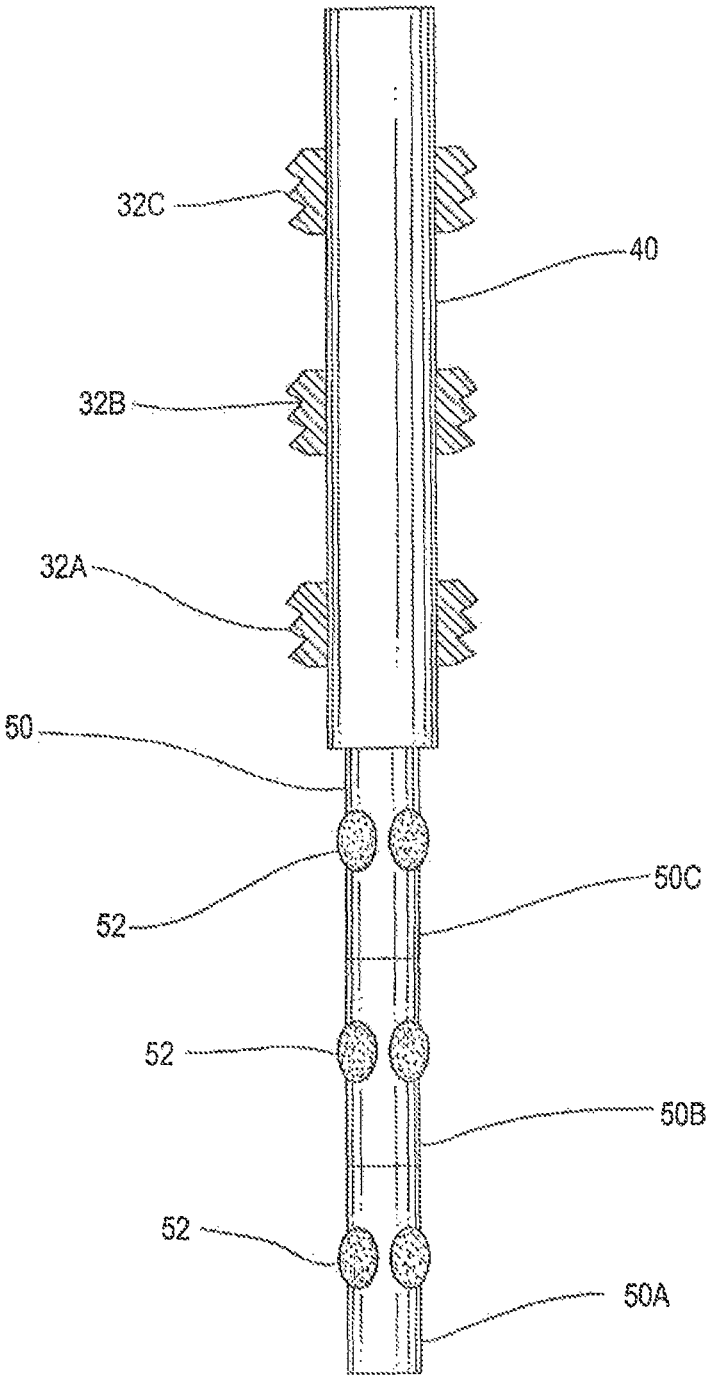
FIG. 3 is a simplified schematic illustration of a perforating gun in accordance with the invention fitted with first, second and third gun sections and their corresponding latching tools for effecting multiple penetrations without having to retrieve the gun for reloading at the surface.

Referring now to the schematic diagram of FIG. 3, the novel configuration of gun assembly 50 is adapted for use with wells that are equipped with a latch coupling as described above and saves rig time that would otherwise be required for the multiple gun trips in the practice of the method described in connection with FIGS. 1A-F. The gun assembly 50 attached to tubing 40 includes first, second and third firing sections 50A, 50B and 50C, respectively, each of which is fitted with a plurality of shaped charges 52. The tubing is also fitted with three latch tools, represented schematically by elements 32A, 32B and 32C, which are adapted to engage a mating fixed latch coupling in the casing when the gun assembly is lowered to the wellbore as described in conjunction with the series of illustrations in FIG. 1. In the practice of the method of the invention, the gun 50 is lowered so that latch tool 32A engages the fixed latch coupling (not shown) and the first section 50A of the gun is fired, detached and dropped into the rat hole at the bottom of the well. Thereafter, the latch tool 32A is disengaged by a downward force and the gun is lowered so that latch tool 32B is engaged with the fixed latch coupling and second section 50B of the gun assembly is in precisely the same position with respect to the first series of penetrations created by the firing of charges 52 in gun section 50A, thereby further penetrating the reservoir. After the second firing and the detachment and dropping of section 50B, the assembly is moved so that latch tool 32C engages the latch coupling and thereby positions the charges of the third section 50C in alignment with the existing penetrations and a third firing is completed. As will be apparent to one of ordinary skill in the art, the spacing of the latch tools 32A, 32B and 32C corresponds to the spacing of the shaped charges on the first through third sections of the gun 50. As will also be apparent to those of ordinary skill in the art from this description, the gun assembly 50 can consist of two, three or more sections, each of which will have a corresponding latch tool positioned above to assure proper vertical alignment of the charges in the interval to be penetrated.

Figure 4:
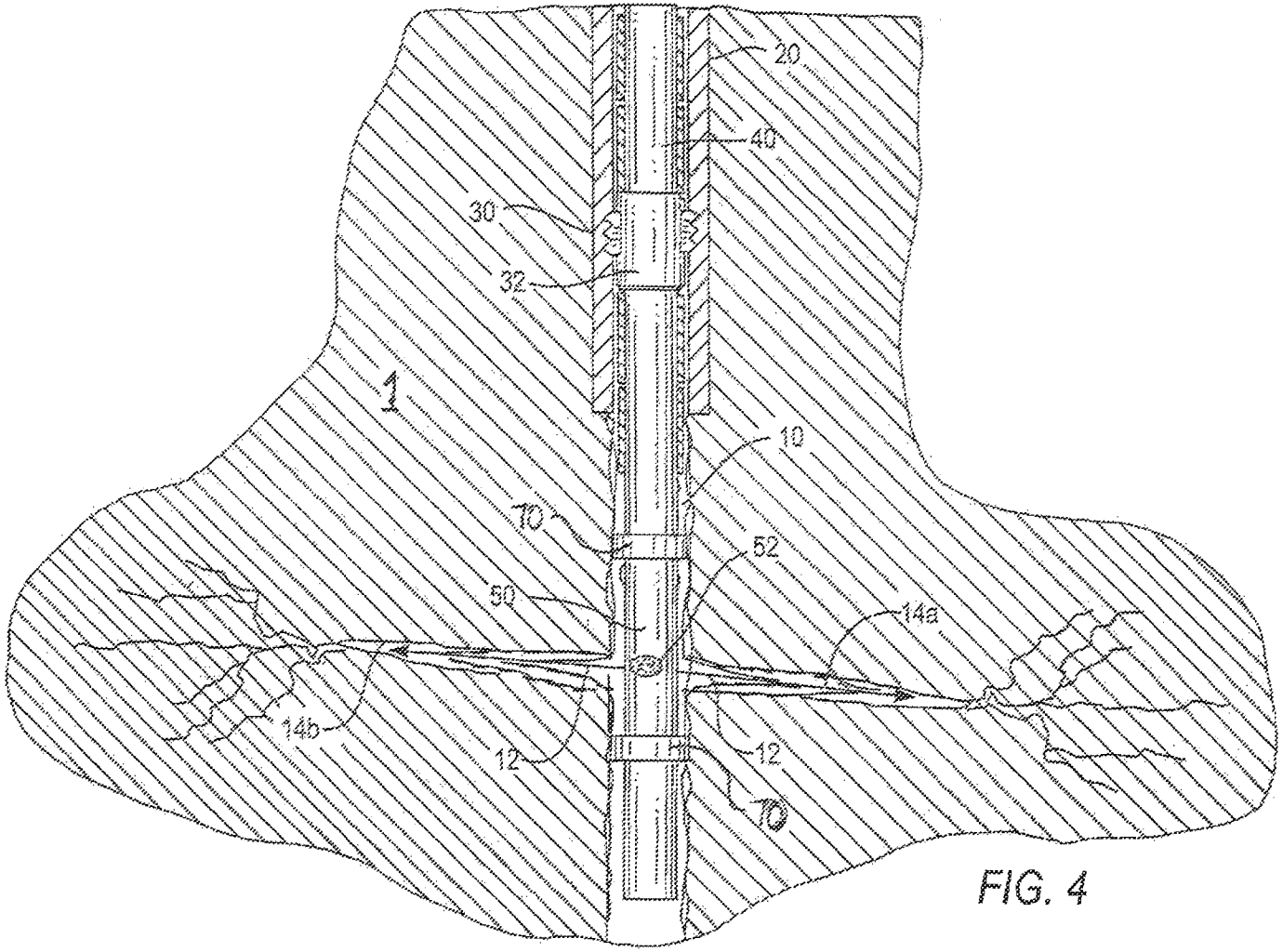
FIG. 4 is a schematic illustration, partly in section, of a final fracturing completion in accordance with the present invention with the fracturing port facing the penetrations previously created by three separate gun shots.

Referring now to FIG. 4, there is depicted a cross-sectional view representing the reservoir 1 following the firing of three separate charges at the same location. The first charge produces a penetration to a depth and of a size corresponding to 12; the second firing penetrates deeper to form region 14*a*; and the third firing penetrates a further depth represented by region 14*b*. Thus, FIG. 4 represents a final fracturing completion employing the latching tool 30 which is lowered by a production tubing 40 using a rig to land on the latch coupling 30, and to position the hydrofracking fluid ports 55 of the completion opposite the holes in the reservoir which were created previously by the three gun shots at the same location. Also shown in FIG. 4 are a plurality of packers 70 which serve to isolate the hydraulic fracturing fluid when it is discharged from the ports to assure maximum penetration of the fluid into the surrounding formation 1 and thereby avoid its premature loss down the wellbore.

Figure 5:
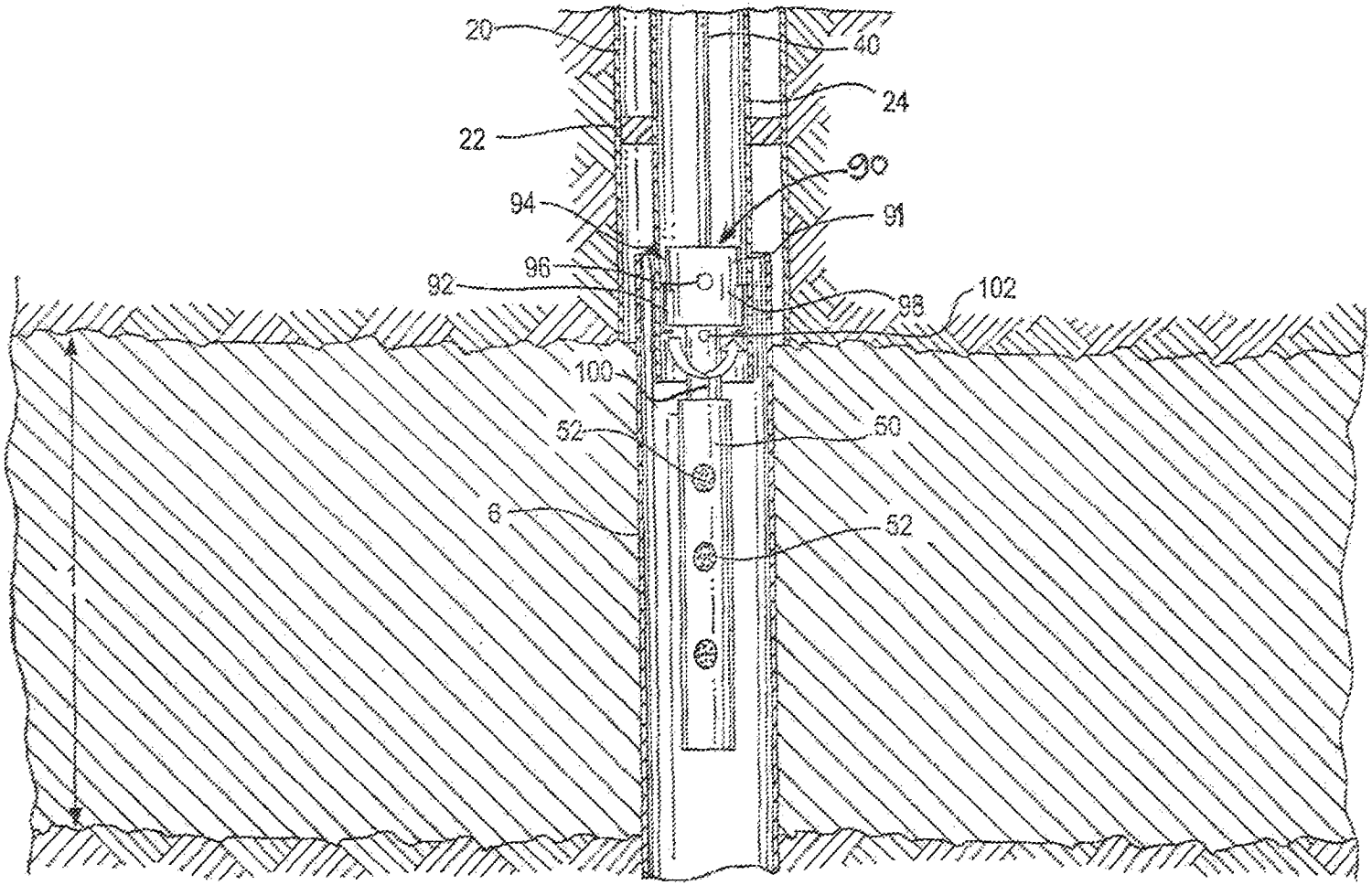
FIG. 5 is a schematic illustration of an apparatus of the invention in which a perforating gun is mounted on a novel gun landing and orientation tool that can be run in the well by wireline or coil tubing.

Referring now to the schematic diagram of FIG. 5, a perforating gun 50 with charges 52 is shown in position and ready for firing to penetrate the desired interval in reservoir rock 1. In this completion, a section of liner 6 has been put into position at the bottom of casing 20 to span the reservoir interval that is to be penetrated. As will be understood by those of ordinary skill in the art, the charges 52 for the initial firing are sufficient to perforate steel liner 6 and to penetrate an initial depth into reservoir rock 1, e.g., to a depth 12 as shown in FIG. 1B. In accordance with the present invention, the second and any subsequent firings will be aligned with, and will pass through the perforations in liner 6 created by the first charges and will thereafter penetrate further into the reservoir to a new depth 14 as was described in conjunction with the series of FIGS. 1A to 1F above.

As indicated in the arrangement of the apparatus of FIG. 5, a tubing profile nipple 80 (TPN) is affixed to the lower end of the bottom section of production tubing 24 which is centered in casing 20 by packer 22. An orientation sub 90 is secured to the upper end of gun 50. The profile nipple 80 serves to land, or stop, the orientation sub 90 which in turn is attached to a wireline or the end of a coil tubing 40 for placement and retrieval inside of the production tubing 24.

In this arrangement, the orientation sub 90 serves to assure that the gun to which it is attached will assume the same axial orientation when it is repeatedly lowered into its final position for successive firings. The depth of the gun is determined by the landing on the profile nipple 80. After each of the first and subsequent firings of the gun, it is retrieved to the surface for reloading or, after the final firing, for removal from the well. The time required to retrieve the gun and return it for subsequent firings is not significant in terms of time or expense when the advantages of the deeper and larger diameter penetrations are taken into consideration, along with the eventual benefits of enhanced gas production.

In the schematic illustration of the apparatus in FIG. 5, a wireline or coil tubing arrangement is employed for same-location multiple reservoir penetrations for those completions where the production tubing 24 is the last string in the well. The tubing in these completions is equipped with a profile nipple 80. The gun can be lowered and controlled via a wireline or coil tubing and positioned in the profile nipple 80 which is secured to form an integral part of the production tubing 40. In this system, the profile nipple 80 provides a fixed reference for the gun depth.

A gun landing and orienting tool (GLOT) 90 is secured to the upper end of gun 50. The GLOT provides secure positioning and directional control for the gun 50 that is removably secured beneath it. The GLOT includes a housing 91, external arms 92 that expand radially to engage the adjacent surface of the profile nipple and releasably secure the GLOT after it has landed or come to rest on the nipple 80. A directional surveying tool with receiver and sensor 94 and a transmitter sensor 96 orients the GLOT in the landed position. A motor 98 is operably connected to rotating shaft 100 and the shaft is provided with a transmitting sensor 102 on the rotatable shaft to determine the relative position of the shaft and the attached gun 50 upon landing on the nipple 80, and after rotation. A programmed microprocessor and associated memory (not shown) are included in the GLOT to process the signals from the sensors and control motor 98 and the rotation of shaft 100 to orient attached gun 50. In the practice of the method of the invention, the gun 50 and the GLOT 90 assembly are lowered by wireline or coil tubing to make the first penetration of the reservoir interval. The GLOT engages and is secured in position by the expandable arms 92 to the production tubing profile nipple 80. The directional survey tool with the receiver sensor 94 and the transmitter 102 are actuated to determine the relative position of the GLOT based on the location tool direction transmitter 96. During running in hole for the first perforation, the GLOT transmitter, the rotating shaft transmitter and the gun charges are lined up in the same direction. Therefore, the first perforations made in the formation are in the same direction as the GLOT transmitter 96. After the first penetration is completed, the GLOT is released from the profile nipple 80 by retracting the arms 92 and the GLOT and gun assembly are withdrawn from the well bore. Retraction of arms 92 can be controlled by the on-board microprocessor, signals from the surface or mechanical means.

The gun is loaded with new charges and the assembly is run in the well for the second penetration. The GLOT 90 lands on the profile nipple 80 and again is secured in position by the expandable arms 92. As in the first run, the tool direction transmitter 96 and the rotating shaft direction transmitter 102, and the gun charges are aligned during the running from the surface and landing. The directional survey tool 94 determines the second landing orientation of the GLOT and direction transmitter 96, and thereafter the shaft 100 of the GLOT is rotated by the motor 98 to position the gun charges beneath it in the same orientation as the first penetration. The gun is fired to extend the second penetration deeper into the formation.

In this embodiment, the gun landing and orienting tool serves to assure that the gun to which it is attached assumes the same axial orientation when it is repeatedly lowered into its final position for successive firings. The depth of the gun is consistently the same because it comes to rest, or lands, on the profile nipple 80, the position of which is fixed on the end of the casing string above the interval that is to be penetrated by the perforating gun charges. After the first and subsequent firings of the gun, it is retrieved to the surface for reloading or, after the final firing, for removal from the well.

Figure 6A:
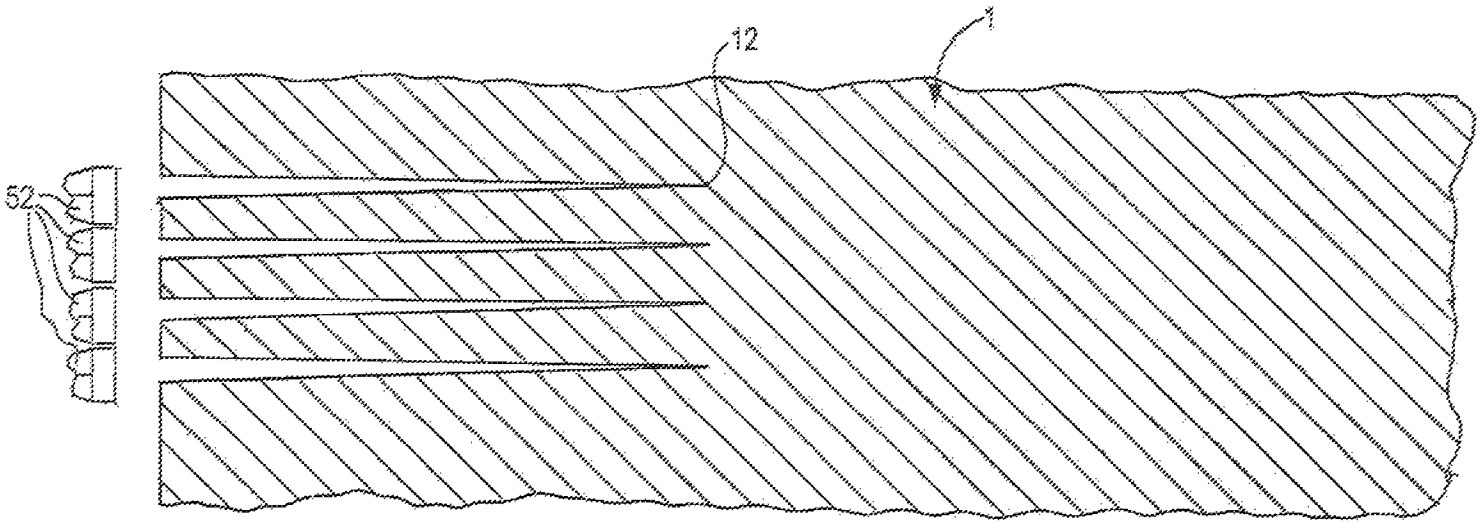
FIGS. 6A through 6H schematically illustrates an alternative embodiment of a method of the invention for same-location multiple firings to form a large cavity in a reservoir interval and the order and number of the shots.
Figure 6B:
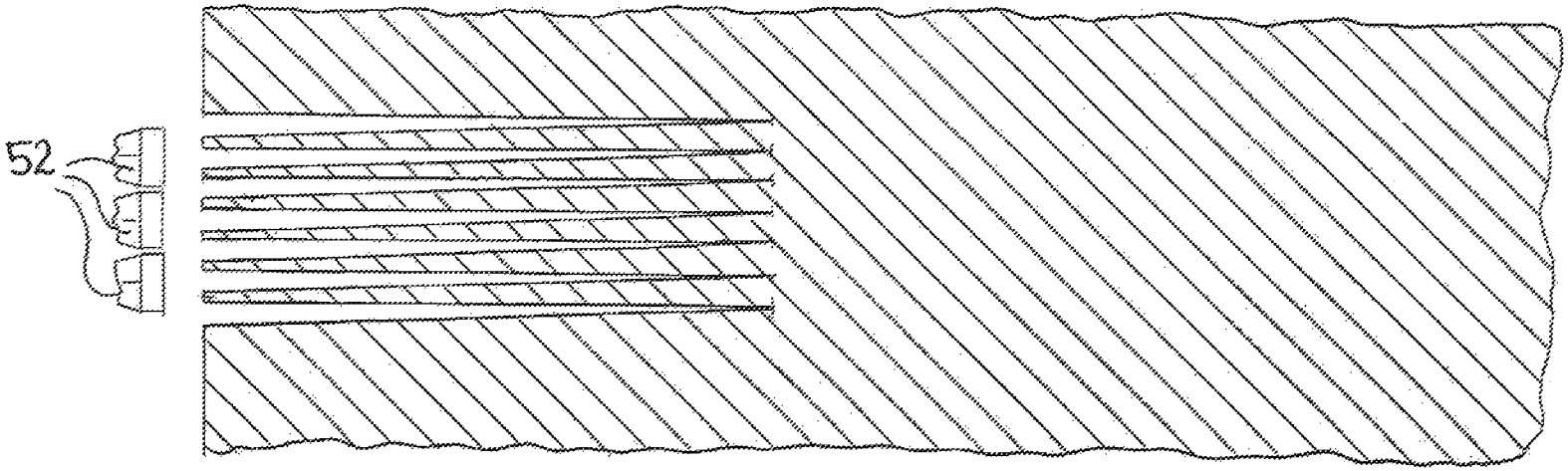
Figure 6C:
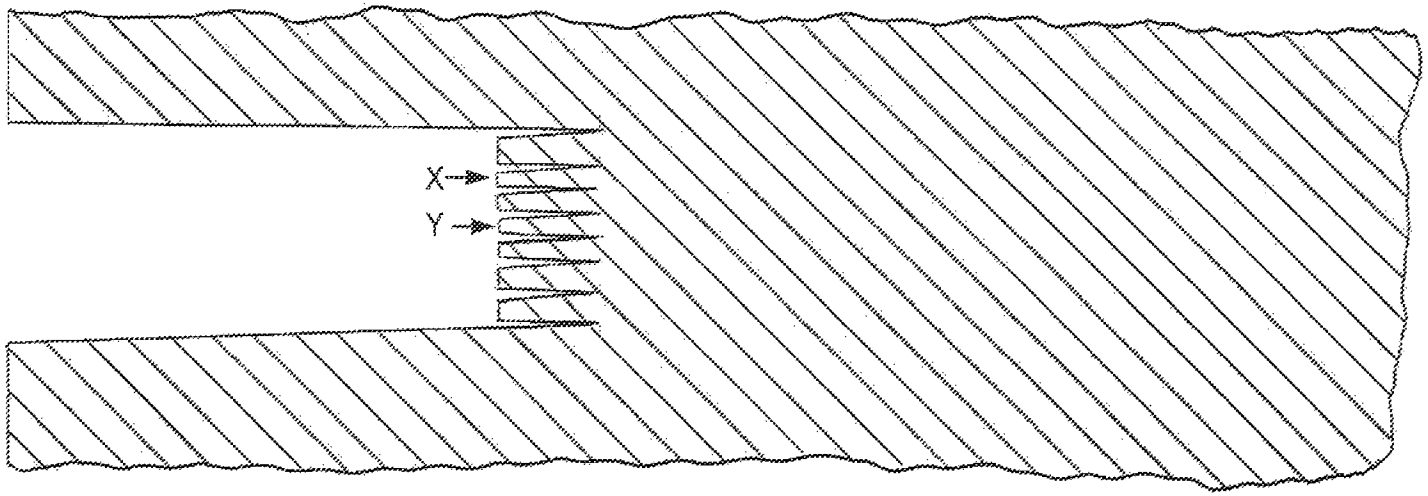

Referring now to the series of highly simplified schematic illustrations identified as FIGS. 6A to 6H there will be described an embodiment of the method of the invention in which a sequence of shaped charges 52 are fired to produce a large cavity for the injection of hydrofracturing fluids and the eventual recovery of hydrocarbon fluids from the reservoir. Referring to FIG. 6A, a first gun run fires charges that produce four parallel channels, after which the gun is withdrawn for reloading at the surface. With reference to FIG. 6B, a second gun run with three charges are fired targeting the weak rock between the previous four channels. FIG. 6C represents the final shape of the resultant large channel produced after removal of the weakened and broken rock between them.

Figure 6D:
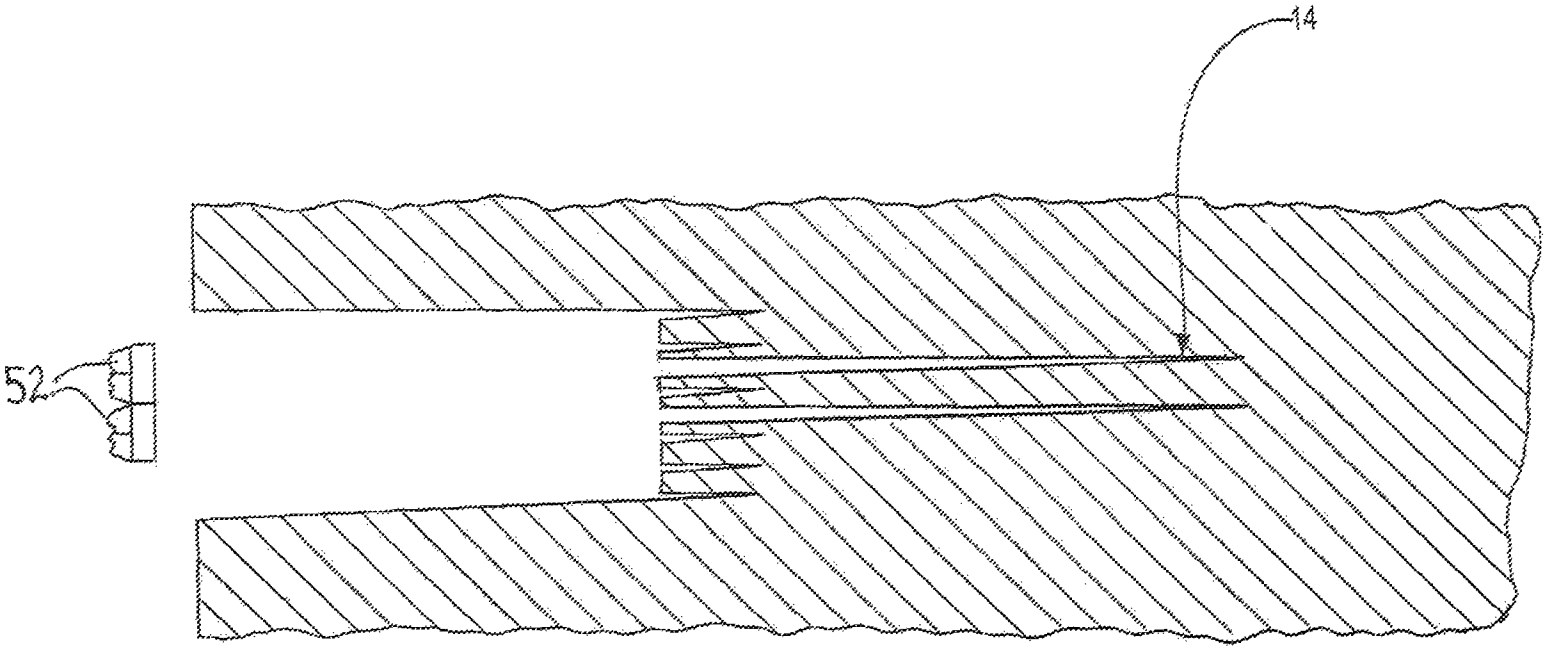
Figure 6E:
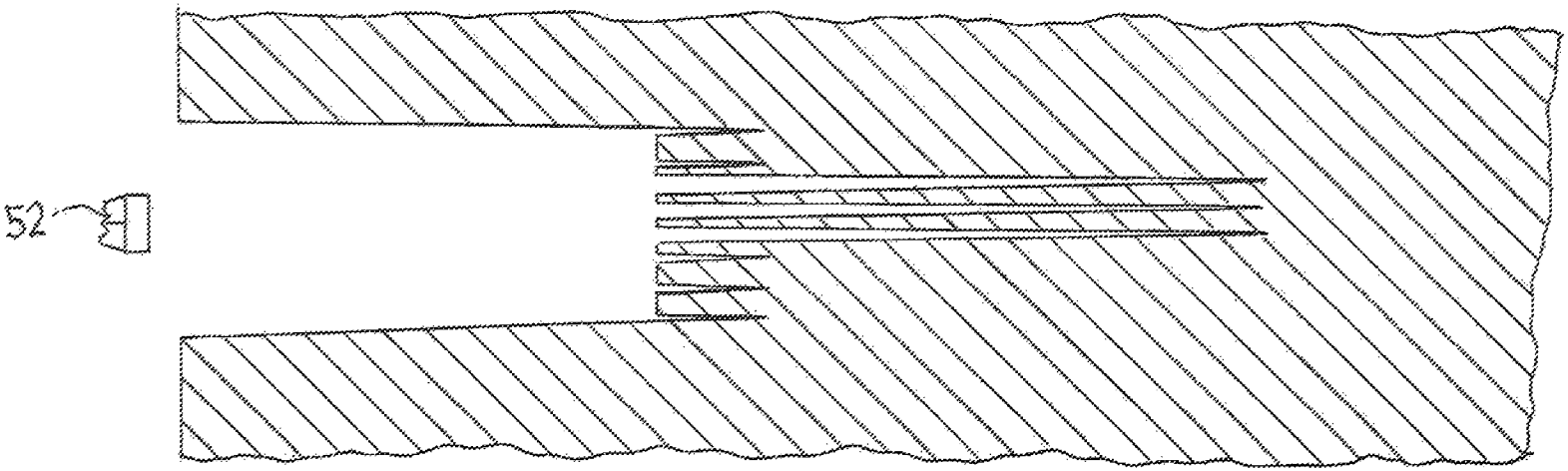

Referring now to FIG. 6D, a third gun run fires two charges to create two channels in the target areas of X and Y as shown in FIG. 6C. With reference to FIG. 6E, a fourth gun run fires a single charge to create a channel in the weakened rock between the two channels created by the third gun run of FIG. 6D that extends to a depth 14.

Figure 6F:
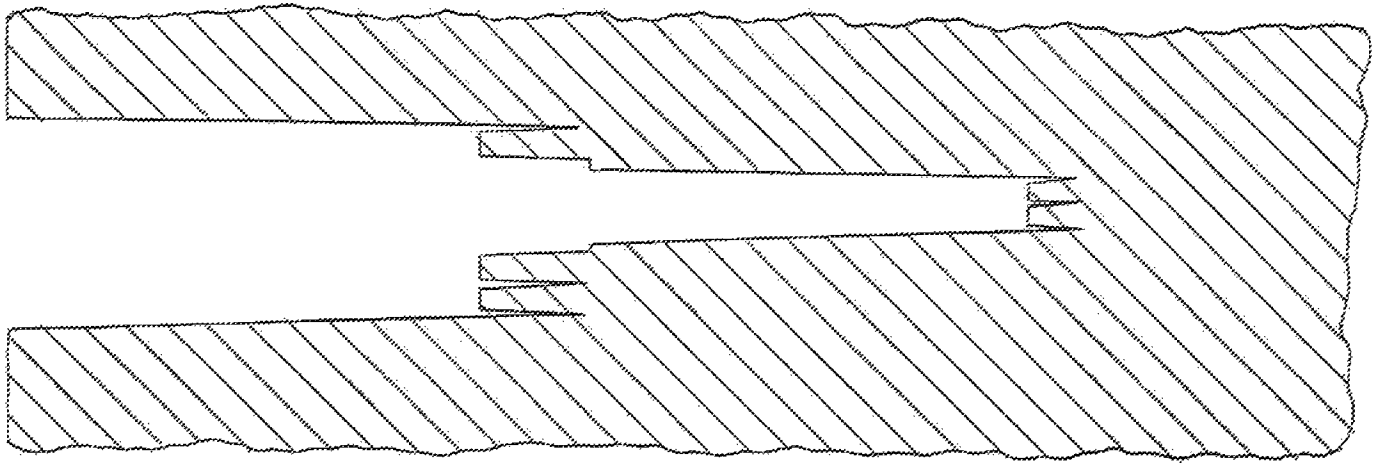
Figure 6G:
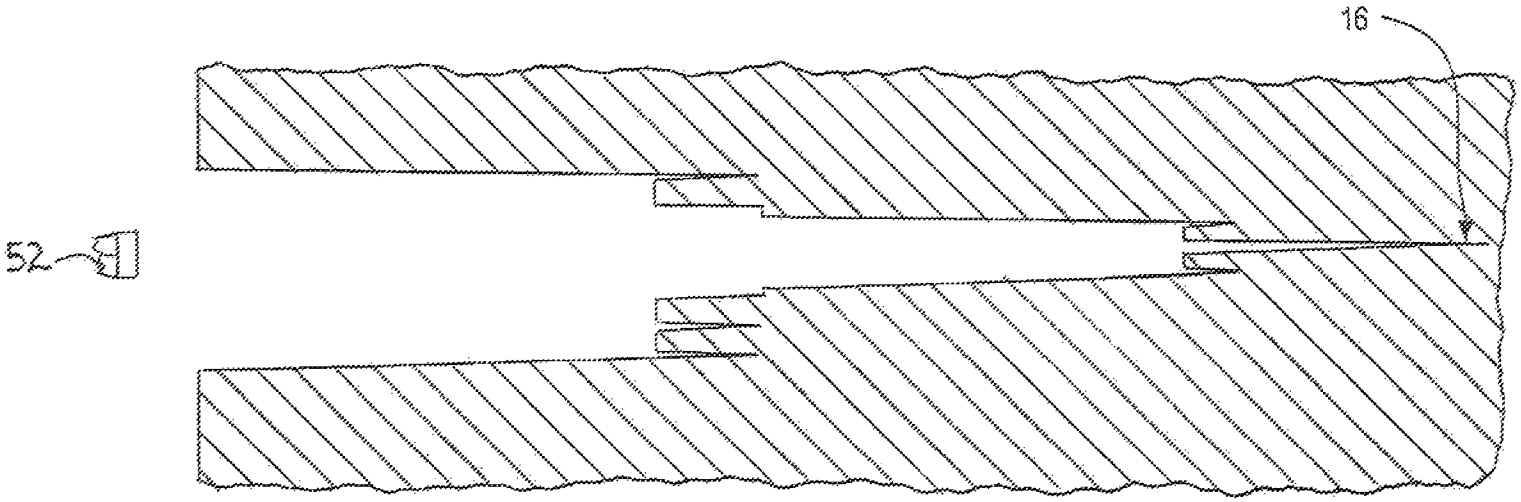

Referring to FIG. 6F, the final shape of the resultant large channel is shown after clearing the weakened and broken rock from between the last three channels. With reference to FIG. 6G, a fifth gun run fires a single charge to produce another channel in about the middle of the cavity shown in FIG. 6F.

Figure 6H:
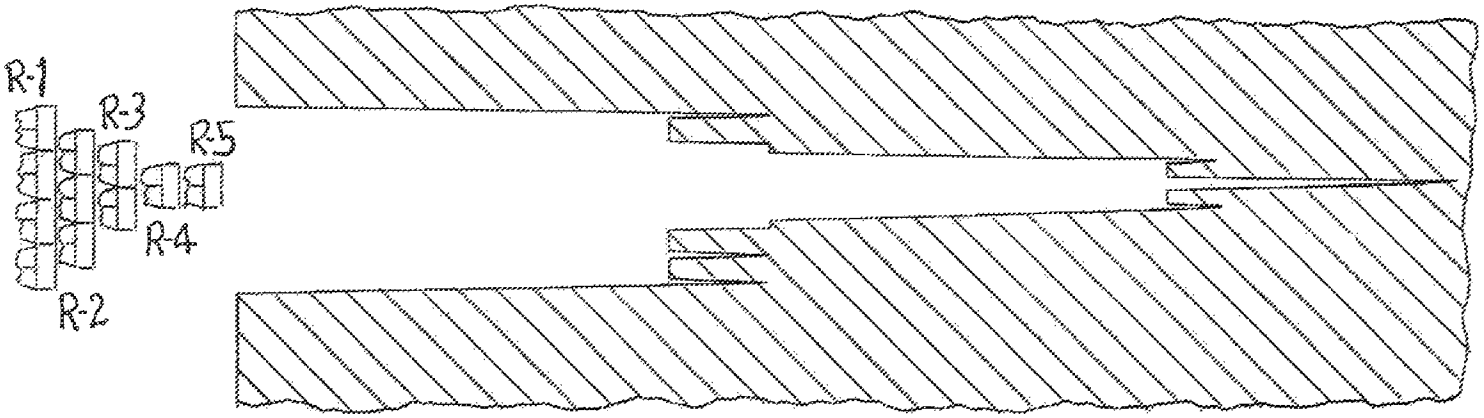

In FIG. 6H, a composite schematic illustration represents the number of shaped charges fired in each of the respective gun runs 1 through 5 as described above and the resultant cavity produced.

The method and apparatus of the present invention overcomes tight formation productivity problems because the same interval can be perforated two or more times to create the larger and deeper holes needed to reach the virgin portion of the reservoir for higher well productivity and/or well injectivity. Additionally, the method facilitates stimulation treatments in especially tight formations of high compressive strength where achieving deep perforation penetration is particularly difficult. This invention provides for the efficient perforation of tight rock formations to achieve successful hydraulic fracturing treatments.

The size of the wellbore drilled in tight gas reservoir rock depends upon the overall well design from the surface to the reservoir target zone. In some wells, the target zone is drilled with a 8⅜" hole; in other wells, the target zone is drilled with a 5⅞" hole. The 8⅜" hole is cased with 7" pipe liner. The 5⅞" hole is cased with a 4½" liner. In an open hole, or OH completion, the hole drilled in the target zone is left open without a cemented pipe liner. In a closed hole, or CH completion, the target zone is provided with a cemented pipe liner. The liner extends from the bottom of the OH to +/−300 feet inside the casing above the open hole. The casing extends to the earth's surface. The design of the well will take into consideration the size and positioning of the various tools and fittings required in the practice of the invention as described.

Although the apparatus and method have been described in detail above and illustrated in the drawings, modifications and variations from this description will be apparent to those of ordinary skill in the art, and the scope of protection for the invention is to be determined by the claims that follow.

The invention claimed is:

1. A method of sequentially performing a plurality of perforations at a predetermined downhole interval of a wellbore in a tight reservoir rock formation in order to produce successively deeper penetrations into the rock, the method comprising:

a. securing a latch coupling to a stationary length of casing at a predetermined fixed position above and proximate to the interval to be perforated;

b. providing a perforating gun comprised of a plurality of sections where each section contains a plurality of shaped charges positioned in a predetermined array, where the array is the same for each section, and the arrays are axially and radially aligned with each other;

c. securing the perforating gun to the downhole end of a supporting member;

d. securing to the supporting member a plurality of latching tools that correspond in number to the plurality of sections comprising the perforating gun, the latching tools being spaced apart axially on the supporting member of a distance that corresponds to the axial distance between the shaped charge arrays in the sections comprising the perforating gun;

e. lowering the first section of the plurality of sections comprising the perforating gun into position adjacent the predetermined interval to be perforated;

f. releasably engaging with the latch coupling a first latching tool of the plurality of latching tools that is closest to the perforating gun;

g. firing a first series of charges from the first section of the gun to penetrate the reservoir rock along the predetermined interval with a first series of openings;

h. releasing the first latching tool to disengage the tool from the latch coupling and lowering the gun to engage the adjacent latching tool with the latch coupling to position a second section of the plurality of sections of the perforating gun adjacent the first series of penetrations;

i. firing a subsequent series of charges from the second section of the gun into the formation at the same locations as the first series to provide openings penetrating deeper into the formation than the first series of openings, and j. repeating steps (h) and (i) until all of the charges in the sections comprising the perforating gun have been fired.

2. The method of claim 1 which the perforating gun is comprised of at least two sections.

3. The method of claim 1 which the perforating gun is assembled with three sections.

4. The method of claim 1 which the latching tool is moved vertically to disengage the latching tool from the latch coupling.

5. The method of claim 1 which the gun fires in response to a signal transmitted from the earth's surface.

6. A method of sequentially performing a plurality of perforations at a predetermined downhole interval of a wellbore in a tight reservoir rock formation in order to produce a large cavity for introducing hydrofracturing fluids, the method comprising:

a. securing a latch coupling to a stationary length of casing at a predetermined position above and proximate to the interval to be perforated;

b. providing a perforating gun comprised of at least two sections, wherein a first section contains a plurality of n shaped charges, and wherein a second section contains a plurality of n−1 shaped charges, and wherein the charges in the at least two sections are axially and radially aligned with each other;

c. securing the perforating gun to a downhole end of a supporting member;

d. securing to the supporting member a plurality of latching tools that correspond in number to the sections comprising the perforating gun, the latching tools being spaced apart axially on the supporting member a distance that corresponds to the axial distance between the sections comprising the perforating gun;

e. lowering the first section of the at least two sections comprising the perforating gun into position adjacent the predetermined downhole interval to be perforated;

f. releasably engaging with the latch coupling a first latching tool of the plurality of latching tools that is closest to the perforating gun;

g. firing the charges of the first section to penetrate the reservoir rock along the interval with a plurality of n openings;

h. releasing the first latching tool to disengage the first latching tool from the latch coupling and lowering the gun to engage a latching tool adjacent the first latching tool of the plurality of the latching tools with the latch coupling to position the second section of the at least two sections into a position wherein the n−1 charges are targeted at any weakened rock that remains between each adjacent pair of openings of the n openings;

i. firing the charges of the second gun section into the formation;

j. retrieving the perforating gun; and k. removing the weakened and broken rock remaining from the firings.

7. An apparatus for penetrating a first predetermined downhole interval and a second predetermined downhole interval of a tight reservoir rock formation adjacent a well bore, the apparatus comprising a perforating gun comprising first and second sections containing shaped charges, the perforating gun being releasably attached to the downhole end of a latching tool, the end of the latching tool opposite the downhole end being secured to the end of a length of coiled tubing or a wireline for controlling movement of the latching tool from the earth's surface, where the latching tool is configured to enter into secure releasable mating engagement with a first latch coupling that is secured to a section of fixed well casing at a predetermined position above and proximate the first predetermined interval and with a second latch coupling that is secured to a section of fixed well casing at a predetermined position above and proximate the second interval that are to be penetrated by the sequential firing of the respective shaped charges contained in the first and second sections of the gun, where the latching tool has a plurality of radially projecting members which are releasably received in a plurality of corresponding recesses in an interior surface of the first and second latch couplings and the upper and lower surfaces of the projecting members of the latching tool and recesses in the surfaces of the respective latch couplings are configured to radially orient the gun sections and to permit axial movement of the latching tool relative to the first and second latch couplings in either a downhole direction or towards the earth's surface, where the latching tool and the attached gun are releasably disengaged from the respective latch couplings by application of either a downward force or an upward force, whereby the gun can be disposed to at least a second operable position at the second interval that is to be perforated without withdrawing the gun to the earth's surface.

* * * * *